United States Patent [19]

Torii et al.

[11] Patent Number: 4,642,662

[45] Date of Patent: Feb. 10, 1987

[54] CARBONLESS PAPER FOR USE IN LETTER PRINTERS

[75] Inventors: Takahiro Torii, Hyogo; Mamoru Ishiguro; Hideaki Senoh, both of Takasago, all of Japan

[73] Assignee: Mitsubishi Paper Mills, Ltd., Tokyo, Japan

[21] Appl. No.: 662,416

[22] PCT Filed: Jan. 26, 1984

[86] PCT No.: PCT/JP84/00017

§ 371 Date: Sep. 25, 1984

§ 102(e) Date: Sep. 25, 1984

[87] PCT Pub. No.: WO84/02883

PCT Pub. Date: Aug. 2, 1984

[30] Foreign Application Priority Data

Jan. 26, 1983 [JP] Japan ..... 58-9158[U]

[51] Int. Cl.[4] ..... B41M 5/22

[52] U.S. Cl. ..... 346/215; 346/219; 346/225; 346/226; 427/150

[58] Field of Search ..... 346/200, 215, 219, 226, 346/225; 427/150–152

[56] References Cited

U.S. PATENT DOCUMENTS

| | | | |
|---|---|---|---|
| 4,036,511 | 7/1977 | Maalouf | 346/226 |
| 4,335,013 | 6/1982 | Allart et al. | 346/213 |
| 4,509,065 | 4/1985 | Shawton | 346/226 |

*Primary Examiner*—Bruce H. Hess

*Attorney, Agent, or Firm*—Cushman, Darby & Cushman

[57] ABSTRACT

A carbonless paper produced by using, as leuco dye solution-containing microcapsules, synthetic high molecular wall membrane microcapsules and, as a color developing agent, an inorganic solid acid gives smooth printing when used in letter printers. This paper has various advantages in printing by letter printers such as no attack for photosensitive plates or masters, no generation of offensive smells or fumes at the time of thermal fixation and no destruction of microcapsules in wet development.

2 Claims, 1 Drawing Figure

CARBONLESS PAPER FOR USE IN LETTER PRINTERS

TECHNICAL FIELD

This invention relates to a carbonless paper for use in letter printers which causes no trouble during or after printing.

BACKGROUND ART

In recent years, letter printers have come into wide use with the development of office automation.

In letter printers, a memory of a computer-controlled image including letters is output, namely, printed on a paper by an image-forming mechanism of electrophotography or electrographic recording. That is, an electrostatic latent image formed on a photosensitive plate of photoconductor by electrophotography or on a dielectric master by electrographic recording, is developed by a toner, whereby the latent image is transferred and fixed on a paper as a visualized toner image and an image print is obtained. These letter printers, being able to print even complicated letters like most Chinese characters, have a pet name of "kanji printers" (kanji refers in Japanese language to Chinese characters) in Japan.

Toner image formation, namely, development is conducted by a dry method or by a wet method (the wet method is also called a liquid drying method). A toner image transferred onto a paper is melt-fixed (thermally fixed) in the dry method by being heated to several hundreds centigrade (e.g. 200° to 300° C.). In the wet method, there are transferred onto a paper not only a toner image but also a solvent of a developing solution and, therefore, the toner image is fixed with heating (this heating also serves to vaporize the solvent).

As the paper for letter printers, there have hitherto been used plain papers as well as slightly processed papers. Recently, carbonless papers have come to be used. This is because printing of formats of account books, chits, etc. can be made by a letter printer, and printing of letters can be made by an impact printer or hand writing and copying.

In carbonless papers, various chemicals are coated as mentioned below. This causes many troubles during printing on these papers by a letter printer. Such troubles are summarized as follows.

1. Since the photosensitive plate or master of a letter printer contacts directly with the surface of a lower (or intermediate) sheet of carbonless paper where an acidic substance is coated, there are cases that the plate or master is chemically attacked after repeated use.

2. Since carbonless papers are exposed to high temperatures at the time of thermal fixation of a transferred toner image particularly in the dry method, there are cases that the lower (or intermediate) sheet of carbonless paper produces the smell and/or fume of chemicals.

3. Particularly in wet (liquid drying) development, there are cases that microcapsules coated on the upper (or intermediate) sheet of carbonless paper are destroyed by a solvent of a developing solution.

DISCLOSURE OF THE INVENTION

The present inventors carefully analyzed the above troubles to grasp their causes. As a result, it was made clear that the above troubles 1 and 2 occur more often when the acidic substance in the color developing layer of lower (or intermediate) sheet is an organic substance

[a phenolic resin, an aromatic carboxylic acid derivative (metal salt) like a salicylic acid derivative (metal salt), or the like] and the above trouble 3 occurs more often when microcapsules have a wall membrane composed mainly of a natural high molecular substance like gelatin.

Hence, the present inventors made a number of experiments to develop a carbonless paper for letter printers which is free from the above mentioned troubles. As a result, there has been invented a carbonless paper for letter printers which comprises at least one of (a) an upper sheet coated at one side with synthetic high molecular wall membrane microcapsules containing a leuco dye solution, (b) a lower sheet coated at one side with an inorganic solid acid and (c) an intermediate sheet coated at one side with synthetic high molecular wall membrane microcapsules containing a leuco dye solution and at the other side with an inorganic solid acid.

The carbonless paper according to the present invention can be used in letter printers very smoothly. With this carbonless paper, photosensitive plates and masters are not chemically attacked; neither smell nor fume is produced at the time of thermal fixation; and microcapsules are not destroyed in wet development.

BEST MODE FOR CARRYING OUT THE INVENTION

Figure 1:
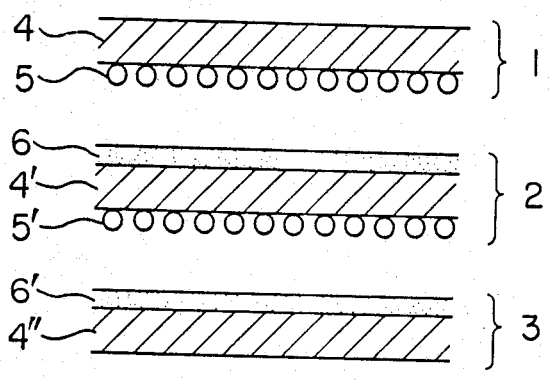
FIG. 1 is a schematic sectional view showing an example of the constitution of the carbonless paper for letter printers according to the present invention.

In one embodiment of the carbonless paper for letter printers of the present invention as shown in FIG. 1, the carbonless paper consists of an upper sheet 1, an intermediate sheet 2 and a lower sheet 3; the upper sheet 1 comprises a base paper 4 and a microcapsule layer 5 coated on the lower side of the base paper 4 (the microcapsules of the layer 5 have a synthetic high molecular wall membrane and contain a leuco dye solution); the lower sheet 3 comprises a base paper 4'' and an inorganic solid acid layer 6' coated on the upper side of the base paper 4''; and the intermediate sheet 2 comprises a base paper 4', an inorganic acid layer 6 coated on the upper side of the base paper 4' and a microcapsule layer 5' coated on the lower side of the base paper 4' (the microcapsules of the layer 5' have a synthetic high molecular wall membrane and contain a leuco dye solution).

As the synthetic high molecular wall membrane microcapsules used in the present invention, there are mentioned microcapsules by an interfacial polymerization process composed of a polyvalent isocyanate compound and an active hydrogen compound (these microcapsules include so-called Fuji In-situ Microcapsules); urea-formaldehyde polycondensation type high molecular wall membrane microcapsules by an in-situ polymerization process composed mainly of urea and formaldehyde; melamine-formaldehyde polycondensation type high molecular wall membrane microcapsules by an in-situ polymerization process composed mainly of melamine and formaldehyde; polyester wall membrane microcapsules; vinyl resin wall membrane microcapsules; and so forth. All of these microcapsules are stouter than microcapsules of wall membrane of a natural high molecular substance like gelatin. Of these, melamine-formaldehyde polycondensation type high molecular wall membrane microcapsules are resistant to both heat and solvents and accordingly were best suited for use in carbonless papers for letter printers.

As the inorganic solid acid, acid clay and active clay [Silton (brand name) produced by Mizusawa Kagaku Kogyo K.K.] both yielding in Japan were sufficient. However, most durable was an inorganic solid acid produced by a semisynthetic production method which is described in Japanese Laid-open Patent Application No. 15996/1982. This inorganic solid acid is produced by acid-treating a clay mineral having a layer structure of regular tetrahedrons of silica so that the $SiO_2$ content became 82 to 96.5% on dry basis (dried at 105° C. for 3 hr), contacting the acid-treated clay mineral in an aqueous medium with a magnesium and/or aluminum compound which is at least partly soluble in the medium (if this soluble magnesium and/or aluminum compound is not a hydroxide, it is neutralized with an alkali or acid so that the compound is converted to a hydroxide) to introduced magnesium and/or aluminum into the acid-treated clay mineral, and, if necessary, drying the resulting clay mineral.

The carbonless paper for letter printers of the present invention was evaluated by a performance test by the use of, for example, Kanji Printer M-8270 manufactured by Mitsubishi Electric for the dry method and Kanji Printer 8500 manufactured by TORAY INDUSTRIES for the wet (liquid drying) method. As a result, the carbonless paper for letter printers of the present invention gave smooth printing with no generation of offensive smell and white fume at the thermal fixation of transferred toner image and also with no destruction of microcapsules by a solvent of a developing solution or heat. Further, this carbonless paper retained, after printing by letter printer, its original function of copying by typing or handwriting.

On the other hand, with commercially available conventional carbonless papers used for comparison whose upper or intermediate sheet was coated with gelatin microcapsules formed by a coacervation process and whose intermediate or lower sheet was coated with color developing agents (acidic substances) composed of a phenolic resin or a zinc salt of a salicylic acid derivative, the intermediate or lower sheet generated offensive smells and/or white fumes at the thermal fixation of toner image particularly in dry development. In wet development, microcapsules coated on upper or intermediate sheet were destroyed to a considerable extent, whereby not only the original copying function of carbonless paper was strikingly damaged but also the whole area of the color developing layer of intermediate sheet turned blue.

Thus, when carbonless papers of conventional type are used in letter printers, there occur troubles in both dry and wet developments.

On the other hand, with the carbonless paper for letter printers according to the present invention, printing is smooth independently of whether it is made in dry or wet development; the original copying function of carbonless paper is kept; and the intermediate sheet does not turn blue. Therefore, the carbonless paper for letter printers of the present invention is very advantageous to users.

As described above, carbonless papers consist generally of an upper sheet, an intermediate sheet and a lower sheet. However, copying is possible when there are combined at least (1) an upper sheet and a lower sheet, (2) an upper sheet and an intermediate sheet, (3) an intermediate sheet and a lower sheet, or (4) two or more intermediate sheets. This also applies to the present invention.

We claim:

1. A carbonless paper used as a pressuresensitive copying paper after having been subjected to printing by a letter printer, which comprises at least one of (a) an upper sheet coated at one side with synthetic high molecular wall membrane microcapsules containing a leuco dye solution, (b) a lower sheet coated with one side with an inorganic solid acid and (c) an intermediate sheet coated at one side with synthetic high molecular wall membrane microcapsules containing a leuco dye solution and at the other side with an inorganic solid acid, said inorganic solid and being semi-synthetic solid acid produced by acid-treating a clay mineral having a layer structure of regular tetrahedrons of silica so that the $SiO_2$ content becomes 82 to 96.5% on dry basis (drying condition: 105° C. for 3 hr), contacting the acid-treated clay mineral in an aqueous medium with a magnesium and/or aluminum compound which is at least partly soluble in the medium (if this soluble magnesium and/or aluminum compound is not a hydroxide, it is neutralized with an alkali or acid so that the compound is converted to a hydroxide) to introduce magnesium and/or aluminum into the acid-treated clay mineral, and, if necessary, drying the resulting clay mineral.

2. A carbonless paper for letter printers according to claim 1, wherein the synthetic high molecular wall membrane microcapsules are melamine-formaldehyde polycondensation type high molecular wall membrane microcapsules.

* * * * *